US006782237B2

(12) United States Patent
Takai et al.

(10) Patent No.: US 6,782,237 B2
(45) Date of Patent: Aug. 24, 2004

(54) SHAPE-CORRECTING DEVICE FOR SHEETS AND ELECTROPHOTOGRAPHIC DEVICE

(75) Inventors: Shingo Takai, Hitachinaka (JP); Yasushi Hashimoto, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 6 days.

(21) Appl. No.: 10/231,176

(22) Filed: Aug. 30, 2002

(65) Prior Publication Data

US 2003/0059240 A1 Mar. 27, 2003

(30) Foreign Application Priority Data

Sep. 21, 2001 (JP) ..... 2001-288084

(51) Int. Cl.[7] ..... G03G 15/00
(52) U.S. Cl. ..... 399/406
(58) Field of Search ..... 399/397, 405, 399/406, 398, 399, 400, 401; 271/188, 209

(56) References Cited

U.S. PATENT DOCUMENTS 4,977,432 A 12/1990 Coombs et al. ..... 399/404
5,066,984 A 11/1991 Coombs ..... 399/406
5,091,754 A * 2/1992 Abe et al. ..... 399/394

FOREIGN PATENT DOCUMENTS

JP 2-95668 4/1990

* cited by examiner

*Primary Examiner*—Hoan Tran
(74) *Attorney, Agent, or Firm*—McGinn & Gibb, PLLC

(57) ABSTRACT

A shape-correcting device, an electrophotographic device (incorporating the shape-correcting device), and a method therefor that correct shaping of a sheet, include a sheet guide member positioned in a sheet transport path upstream from an image forming module formed with an arcuate section that is convex relative to the surface of the sheet and a rotatable roller opposed to the arcuate section and slidable along a direction perpendicular to the rotation axis thereof. The roller rotates and presses the sheet against the arcuate section at a predetermined timing synchronized with a timing and position of the leading end of the sheet.

41 Claims, 4 Drawing Sheets

FIG.7
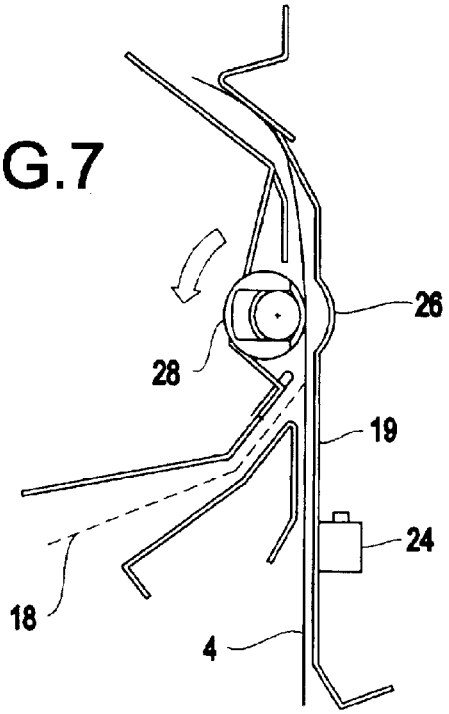
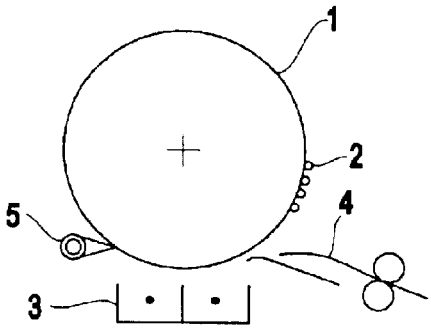
FIG.8
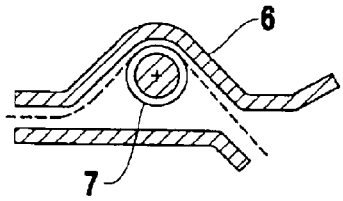
FIG.9
PRIOR ART

SHAPE-CORRECTING DEVICE FOR SHEETS AND ELECTROPHOTOGRAPHIC DEVICE

BACKGROUND OF THE INVENTION

1. Field of the Invention

The present invention generally relates to an electrophotographic device, and more particularly to a transporting device and method of correcting a shape of a transported sheet.

2. Description of the Related Art

A conventional electrophotographic printing device uses a printing method involving electrostatic force. The basic principles of such a conventional electrophotographic printing device are illustrated in FIG. 8.

In this printing method, a photosensitive body 1 is formed by a cylindrical or a belt-shaped member. A laser (not referenced) or the like is used to form an electrostatic latent image on the photosensitive body 1. A powdered material (e.g., paint) used for printing, generally referred to as a toner 2, is adhered to the electrostatic latent image, and this visible image (e.g., a toner image) is transferred to a sheet 4 serving as a recording medium (e g., cut paper) using a device that uses electrostatic force, generally referred to as a transfer device 3. This results in a printed image In this case, forming a good toner image on the sheet 4 serving as the recording medium requires adequate contact between the sheet 4 and the photosensitive body 1.

After the toner image is transferred to the sheet 4, the sheet 4 and the photosensitive body 1 must be quickly disengaged. In electrophotographic devices, this separation of the sheet 4 from the photosensitive body 1 is generally also performed using electrostatic force. Generally, the sheet 4 is disengaged by adjusting the strength of a corona discharge from the transfer device 3 based on the relationship between the electrostatic charge of the photosensitive body 1 and the toner 2, and the electrostatic charge of the sheet 4.

This separation method involving electrostatic force in principle can be expected to effectively separate the sheet 4 if there is no shape irregularity of the sheet 4 such as warping. However, if there is shape irregularity (e.g., warping) in the sheet 4, then the separating ability of the electrostatic force will be unbalanced due to the rigidity or the like of the sheet itself. This can lead to the sheet 4 staying wrapped around the photosensitive body 1.

In particular, if the photosensitive body 1 is formed with a cylindrical shape having a curvature, the sheet 4 will tend to stay wrapped around the photosensitive body 1 more frequently with paper shape that is warped in the same direction as the curvature of the photosensitive body 1 (e.g., the surface of the paper 4 on which printing is to be performed is curved concavely relative to the photosensitive body 1). That phenomenon is caused by a force of static electricity which causes the sheet to stick to the photosensitive body in the small area between sheet and the photosensitive body It is noted that sheet deformation is generally related to heat and humidity.

In electrophotographic devices that perform two-sided printing, the heat applied to fix the toner image to the sheet makes deformation unavoidable. Also, for some types of sheets, the production process thereof will lead to the sheets being formed with deformations such as warping from the start. Thus, the sheets being transported to the image forming module may not necessarily have an ideal flat shape.

In one method used in conventional devices, such a problem is addressed by placing a claw member 5 in contact with the photosensitive body 1 to separate the sheet 4 wrapped around the photosensitive body 1, as shown in FIG. 8. With this method, however, the claw member 5 comes directly into contact with the photosensitive body 1, thereby possibly damaging the photosensitive body 1. This may raise a new problem, because a damaged photosensitive body 1 will have a relatively short service life. Additionally, adhesion of contaminants to the claw member 5 can lead to contaminants becoming adhered to the sheets 4, thereby negatively affecting the print quality.

According to another method, air pressure is used to separate sheets that cannot be separated with electrostatic force. However, this method requires complex devices for performing air suction or compression, thereby leading to increased costs and a less compact design.

U.S. Pat. No. 5,066,984 discloses a device for eliminating sheet warping after printing. FIG. 9 shows a simplified drawing of such a device. In this device, sheet warping is eliminated by passing (e.g., as shown by dotted lines) a sheet through an arcuate gap formed between an arcuate member 6 and a driven roller 7 after the sheet has been printed. Eliminating (or minimizing) warpage requires setting an arcuate gap to 0.6 mm or less (between arcuate member 6 and driven roller 7). Therefore, if the thickness of the sheet is high (e.g., cardboard), then the sheet may not be able to pass through the arcuate gap.

Alternatively, the warpage elimination may be more than necessary, leading to reverse-warping, thereby leading to problems in sheet transport and the stacking of sheets in the sheet ejection device U.S. Pat. No. 5,066,984 proposes a switchable gate disposed at the entry to the arcuate gap with the passage to the device being switched by selecting sheet thickness.

Thus, in the conventional electrophotographic devices described above, a sheet can become wrapped onto the photosensitive body if the side of the sheet to be printed is warped concavely (e.g., printing is to be performed on a sheet having a printing surface that is curved concavely). Also, using a claw member to solve this problem may lead to new problems including shorter service lives of photosensitive bodies and adhesion of contaminants thereto Moreover, with the method involving air pressure, the cost and size of the device increases. Furthermore, the device to eliminate warping after printing described above requires switching the path to the device depending on the thickness of the sheet.

SUMMARY OF THE INVENTION

In view of the foregoing and other problems, drawbacks, and disadvantages of the conventional methods and structures, an object of the present invention is to provide a method and electrophotographic device which overcome the problems described above.

Another object of the invention is to prevent sheets from becoming wrapped around the photosensitive body by installing a device that eliminates curvature of the sheet that is concave relative to the printing surface, without needing to switch the transport path according to a sheet thickness.

In a first aspect of the invention, an arcuate shaped section (e.g., configuration) is disposed on a transport path used to transport a sheet to an image forming module. The arcuate shape is convex relative to the side of the sheet on which printing is to occur. A roller opposing the arcuate section presses the sheet against the arcuate section with an appropriate pressure when the sheet passes the arcuate section The roller is driven in a manner synchronized with the passage of the sheet. The rotation radius of the roller is roughly identical to the curvature radius of the arcuate section The roller is slidable in a direction perpendicular to that of its rotational axis.

In a second aspect of the invention, a shape-correcting device for sheets, includes a guide member for guiding a sheet along a predetermined transport path, an arcuate section formed on a section of the guide member, a roller positioned opposite the arcuate section, and a driving mechanism for driving the roller In a third aspect of the invention, a method of shape-correcting sheets, includes transporting a sheet along a predetermined transport path, the predetermined transport path including a path between an arcuate section formed on a section of a sheet guide member and a roller positioned opposite the arcuate section, driving the roller in synchronization with a transport timing of the sheet, and pushing the roller in a direction perpendicular to a roller rotation axis and pressing the sheet against the arcuate section of the sheet guide member.

Further, in electrophotographic devices used to print to two sides of a recording medium, the inventive structure can be installed upstream from the image forming module and downstream from where the transport path meets a return transport path used for two-sided printing.

The present disclosure relates to subject matter contained in Japanese Patent Application No. 2001-288084, filed on Sep. 21, 2001, which is expressly incorporated herein by reference in its entirety.

BRIEF DESCRIPTION OF THE DRAWINGS

The foregoing and other purposes, aspects and advantages will be better understood from the following detailed description of a preferred embodiment of the invention with reference to the drawings, in which:

FIG. 7 is a simplified drawing showing the operations performed by the embodiment of the shape correction device for sheets according to the present invention;

FIG. 8 is a simplified drawing showing the basic operating principles involved in the electrophotographic device according to the present invention, and FIG. 9 is a simplified drawing showing a conventional device for eliminating warpage of a sheet.

DETAILED DESCRIPTION OF PREFERRED EMBODIMENTS OF THE INVENTION

Figure 2:
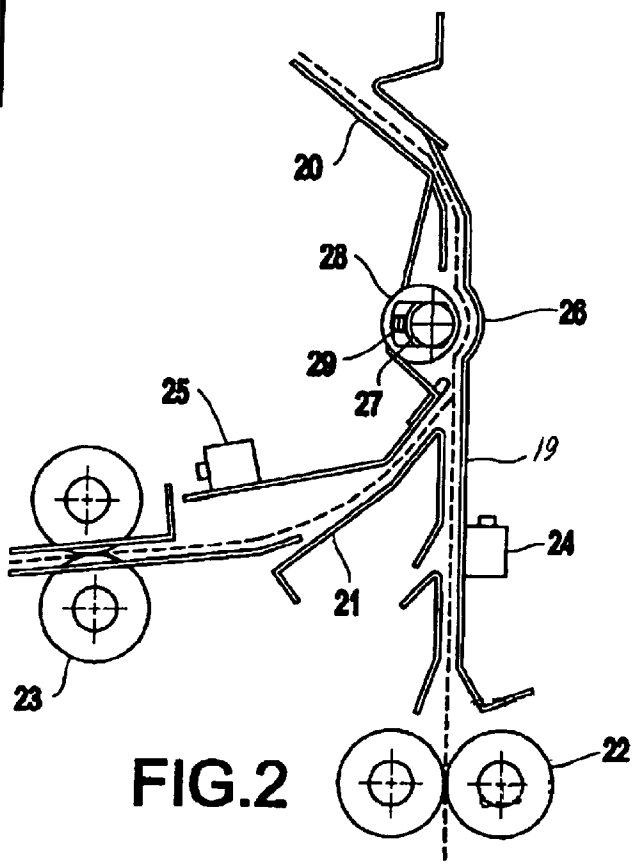
FIG. 2 is a simplified drawing showing an embodiment of a shape correction device for sheets according to the present invention.

Referring now to the drawings, and more particularly to FIGS. 1–7, there are shown preferred embodiments of the method and structures according to the present invention.

Preferred Embodiment

Figure 1:
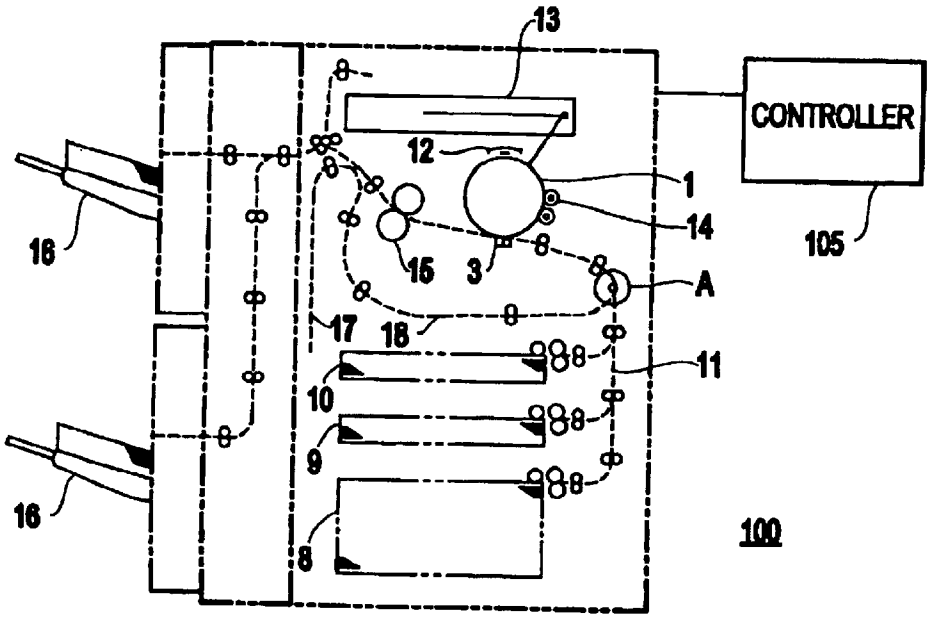
FIG. 1 is a simplified drawing showing an embodiment of an electrophotographic device according to the present invention.

Referring to FIG. 1, the overall architecture 100 of an embodiment of the present invention will be described with reference to an image forming module in a laser printer as an example.

FIG. 1 shows sheet member feeding devices 8, 9, 10. A sheet member, generally referred to as a sheet, is mounted in the sheet member feeding devices 8, 9, 10, and travels through a sheet transport mechanism (e.g., not shown) and a transport path 11 The sheet member is transported through the locations of a photosensitive body 1, which is the image forming module, a transfer device 3, and the like.

The image forming module includes an electrostatic latent image forming means including, for example, a charger and exposure unit, a developing unit, a transfer unit, the photosensitive body 1, and discharger etc.

When the printing operation begins, the photosensitive body 1 begins rotating in response to an electronic signal from a controller 105. When the photosensitive body 1 begins rotating, a corona charger 12 charges the surface of the photosensitive body 1, and an electrostatic latent image is formed by an optical device 13 When the sheet member reaches the position of a developing device 14, imaging is performed with toner, thereby forming a visible toner image on the surface of the photosensitive body 1.

This toner image is timed to match the transport of the sheet by the transport mechanism 3 described above. The toner image then passes through a fixing unit 15, which fixes the image with heat. The sheet then passes to a sheet ejection device 16. With laser printers that can perform two-sided printing, a reversal path 17 reverses the sheet, which then passes through a return transport path 18 and through the image forming module again to provide printing on the reverse side of the sheet.

With this type of laser printer, this embodiment provides a shape correcting device for the sheet member at a point A, which is upstream from the image forming module and downstream from the merging point with the return transport path used for double-sided printing. This shape correcting device will be described with reference to FIGS. 2–7.

First, the structure of the shape correcting device for the sheet member according to the present device will be described FIG. 2 shows guide members 19, 20, 21, which are members generally known as sheet guides. These form the transport path. Roller pairs 22, 23 are used to transport the sheet, and are installed along the transport path Optical sensors 24, 25 detect a sheet transport position.

In this structure, an arcuate section 26 is formed on a section of the sheet guide 19 The arcuate section 26 is formed convexly relative to the surface of the sheet on which printing is to be done and has an appropriate radius of curvature. A rotatable shaft 27 is opposed to this arcuate section 26, and is slidable in the direction perpendicular to the axis of rotation of the rotatable shaft 27.

Rollers 28 have a diameter greater than that of the shaft 27. A compression coil spring 29 is installed inside the slidable roller 28, thereby pushing the rollers 28 in the aforementioned direction. The arrangement of this shaft 27, the rollers 28, and the compression coil spring 29 allows the roller 28 to rotate eccentrically relative to the shaft 27.

The rotation radius of the roller 28 is set to be roughly (e.g., substantially) equal to the curvature radius of the arcuate section 26 of the sheet guide 19. The shaft 27, the rollers 28, and the arcuate section 26 of the sheet guide 19 are positioned so that the roller 28 and the arcuate section 26 come into contact while the roller 28 rotates.

Next, the structures of the shaft 27, the rollers 28, and the compression coil spring 29 and the drive mechanism used to rotate these members will be described in detail using FIGS. 3(*a*) and 3(*b*).

Figure 3A:
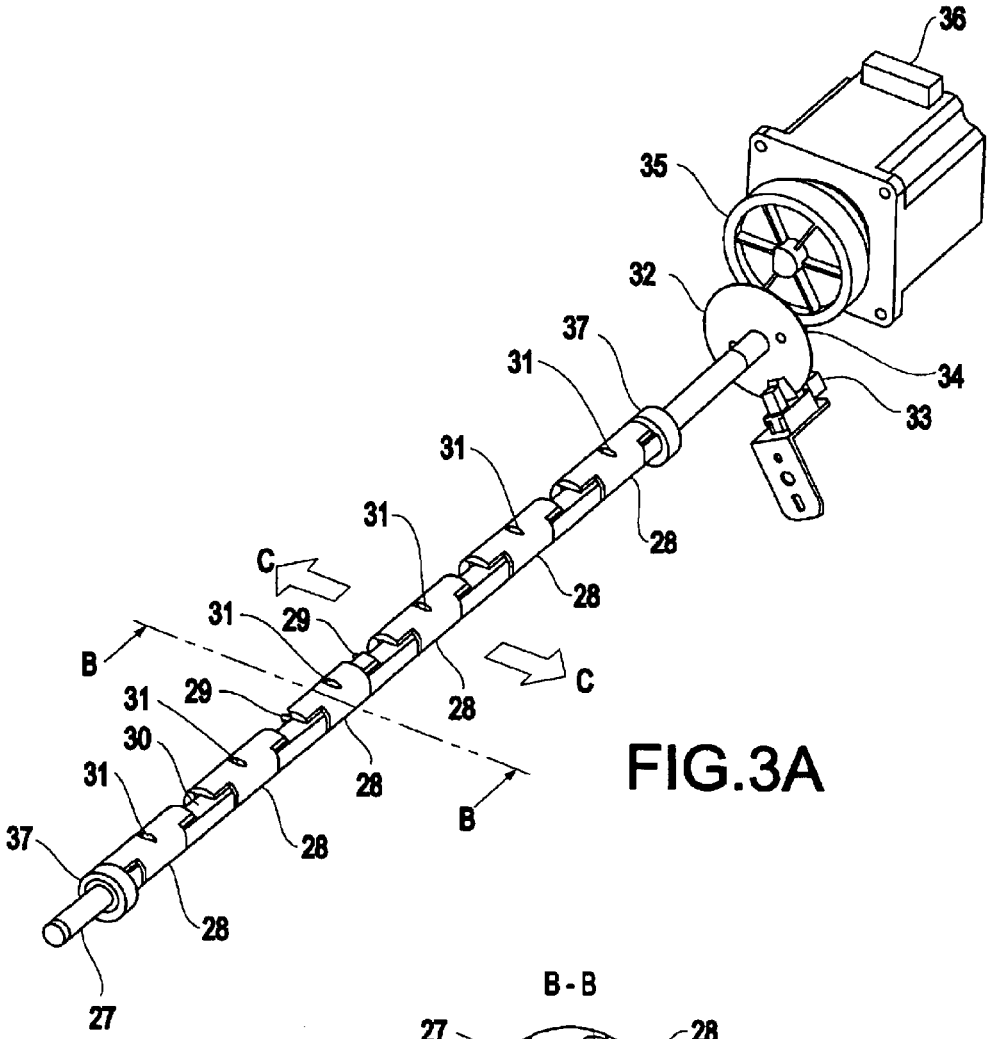
FIGS. 3(*a*) and 3(*b*) respectively are a perspective drawing and a sectional drawing along lines B—B, showing details of a structure in the embodiment of the shape correction device for sheets according to the present invention.
Figure 3B:
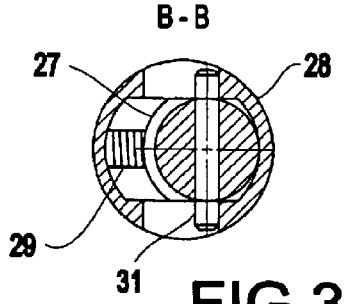

FIGS. 3(*a*) and 3(*b*) show the shaft 27, on which an appropriate number of flat sections 30 are formed. Multiple rollers 28 are disposed on the shaft 27 according to the sheet widths to which the laser printer can print Flat sections are disposed inside the rollers 28 as well, thus forming appropriately sized gaps with the flat sections 30 of the shaft 27. This allows the rollers 28 to slide along the directions indicated by the arrows C perpendicular to the rotational axis of the shaft 27.

Compression coil springs 29 are internally disposed at the ends of the rollers 28, thereby pushing the rollers 28 in one of the C directions. Pins 31 pressed into the shaft 27 restrict the amount by which the rollers 28 can slide and prevent disengagement from the shaft 27. A disc-shaped member 32 and an optical sensor 33 connected to the shaft 27 are means for detecting the rotation position (e.g., the phase) of the roller 28 in the form of electrical signals. The disc-shaped member 32 is generally known as an actuator.

Furthermore, the shaft 27 and the rollers 28 are driven by a stepping motor 36 by gears 34, 35 connected to the shaft 27. A pulley 37 is always in contact with the arcuate section 26 of the sheet guide and serves as a position determining member that maintains accurate positioning between the rollers 28 and the arcuate section 26 (e.g., maintaining a predetermined gap between arcuate section 26 and rollers 28).

Next, the manner in which the shape correcting device for sheet members according to this embodiment corrects curvature caused by the sheet being wrapped around the photosensitive body will be described using FIG. 4 and FIG. 5.

Figure 4:
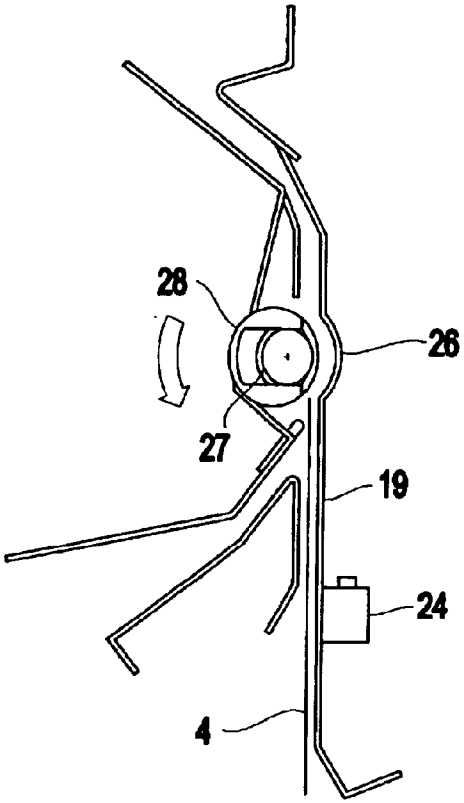
FIG. 4 is a simplified drawing showing the operations performed by the embodiment of the shape correction device for sheets when a leading end of a sheet is detected according to the present invention.

First, as shown in FIG. 4, the sheet fed from the sheet feeding device is transported by the transport rollers 22 shown in FIG. 2 to the arcuate section 26 of the paper guide 19. The optical sensor 24 installed on the paper guide 19 detects the passage of the leading end of the sheet 4.

In synchronization with this signal, a control device (e g , not shown) signals the stepping motor 36 driving the shaft 27 and the rollers 28, to start rotating in the direction of the arrow. The rotation starting position of the shaft 27 and the rollers 28 (e.g., the initial position) is kept at a predetermined position by the stepping motor 36 based on the electrical signal detected by the actuator 32 and the optical sensor 33, shown in FIG. 3(*a*), at an appropriate time before the sheet 4 reaches the arcuate section 26 (e.g., when the main power supply of the laser printer is turned ON or when printing is started).

Figure 5:
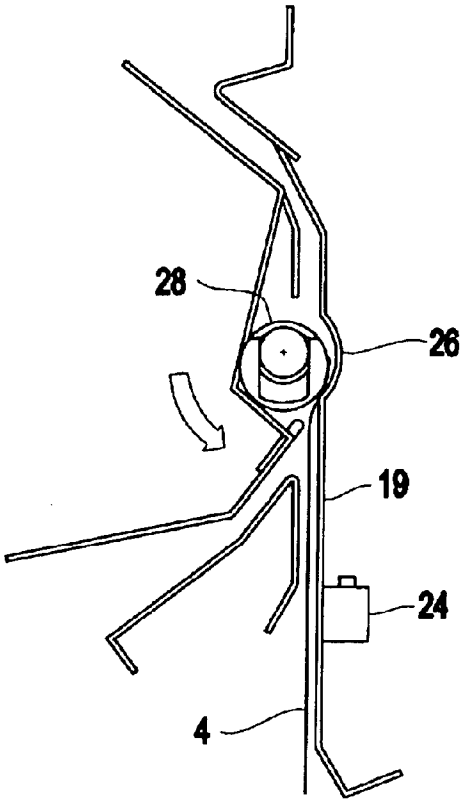
FIG. 5 is a simplified drawing showing the operations performed by the embodiment of the shape correction device for sheets when a roller begins contacting a sheet according to the present invention.

Next, as shown in FIG. 5, the stepping motor applies an acceleration force at an appropriate rate, and the rollers 28 begin contact with the sheet 4. As the rollers begin contact with sheet 4, the angular velocity of the rollers 28 reaches a speed that was set up (e.g, a predetermined speed), and the peripheral speed is controlled to be roughly equivalent to the transport speed of the paper 4. As a result, there is no friction between the surface of the rollers 28 and the surface of the sheets 4. If printing has already been performed on the surface of the sheet 4 contacting with the rollers 28 (e.g., when printing to two sides) image degradation caused by wearing (flaking) off of the toner is prevented.

However, if the toner has been well fixed and does not wear off due to the friction with the surface of the rollers 28, the peripheral speed of the rollers 28 can be set to be faster than the transport speed of the sheet 4. This not only eliminates the arcuate shaping of the sheet, but allows the friction between the sheet 4 and the rollers 28 to actively shape the sheet in the opposite direction from the arcuate shape described above This can provide further elimination of localized arcuate shaping of the sheet 4 or further prevent the sheet from wrapping around the photosensitive body.

However, in this case, the degree of arcuate shaping must be adjusted so that this shaping does not lead to problems such as transport jams.

As a result of the operations shown in FIG. 4 and FIG. 5, transport jams are dissolved because the leading end of the sheet 4 being conveyed first run into the arcuate section 26 of the paper guide 19, thereafter contact is initiated with the rollers 28.

Figure 6:
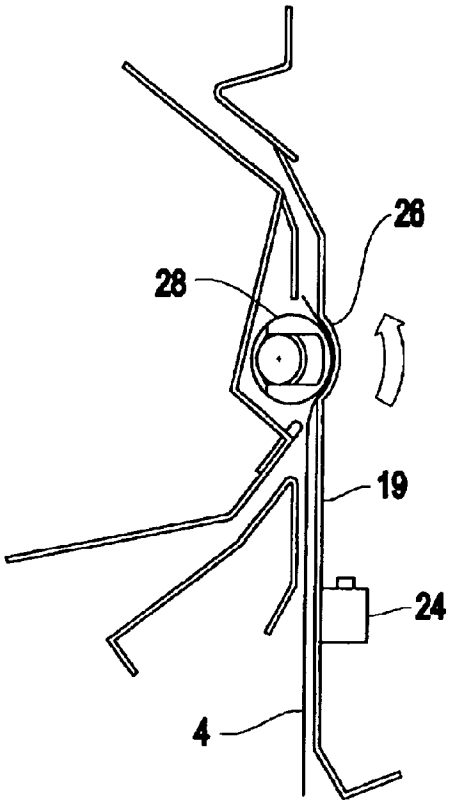
FIG. 6 is a simplified drawing showing the operations performed by the embodiment of the shape correction device for sheets when the sheet is pressed firmly against the arcuate section by the rollers according to the present invention.

Furthermore, when the rollers 28 are rotated to the state shown in FIG. 6 (indicated by the arrow), the leading end of the sheet 4 is pressed tightly against the arcuate section 26 firmly by the paper guide 19 with an appropriate pressure. Then, the arcuate shaping of the sheet 4, which is concave relative to the surface being printed, is eliminated, rather an arcuate shaping in the same direction as the arcuate section 26 is formed.

In this non-limiting embodiment, 55–64 kg (17–20 LB) paper was used, and a laser printer was used having a photosensitive body with a diameter of 170 (mm), a curvature radius of 7 (mm) for the arcuate section 26 of the paper guide 19, diameters of 14 (mm) for the rollers 28, and a depth of 3 (mm) for the arcuate section 26, with pressure of 2±0.4 (gf; gram force) per 1 (mm) sheet length being applied from the sheet to the arcuate section 26.

The embodiment of the present invention, as described above, effectively prevents a sheet 4 from wrapping around the photosensitive body 1. Also, when a sheet 4 not originally having arcuate shaping is printed under the conditions described, no paper transport problems occur since the arcuate shaping that is formed is not significant enough to lead to the problems of the conventional art, such as transport problems.

With paper weighing 90 kg (28 lb) or more (e.g, paper generally referred to as cardboard or "card stock"), the pressure from the rollers 28 under the conditions shown in FIG. 6 cannot overcome the repulsion resulting from the rigidity of the sheet. Thus, with this paper, no arcuate shaping occurs since the adherence to the arcuate shaping is inadequate. Since cardboard sheets themselves generally have a high rigidity as described above, problems involving sheets 4 wrapping around the photosensitive body 1 are infrequent. Thus, with this weight of paper, there may be no need for the shape correction of the present invention so thick papers only run through the shape-correcting device. That is to say, there is no necessity for change the sheet through pass according to thickness of the paper.

Also, from the state shown in FIG. 6, different types of sheets having different widths can be used in this invention since rollers are set up at multiple positions, as shown in FIG. 3 Furthermore, the rollers 28 rotate and then the rotation speed is reduced at an appropriate deceleration rate so that the rollers 28 return to the state shown in FIG. 7 (e g., the initial position shown in FIG. 4) The rollers 28 then stop and the shape correction process for the sheet 4 is concluded Since the sheet 4 does not subsequently adhere to the arcuate section 26, shape correction is only applied to the leading end of the sheet 4.

The operations shown in FIG. 4–FIG. 7 are performed for each sheet. In laser printers that perform two-sided printing, the sheet travels through the return transport path 18 after one side is printed and is then guided to the arcuate section 26 again.

As described above, before a sheet is transported to the image forming module, the present invention provides correction for the arcuate shaping of sheets caused by sheets being wrapped around the photosensitive body. This correction of arcuate shaping is performed only on the leading end of the sheet, so no unneeded shaping takes place outside the leading end.

Furthermore, since the shape correction function does not function when printing on cardboard, the present invention avoids problems such as transport problems caused by the shape of the cardboard being changed.

While the invention has been described in terms of several preferred embodiments, those skilled in the art will recognize that the invention can be practiced with modification within the spirit and scope of the appended claims.

Further, it is noted that Applicant's intent is to encompass equivalents of all claim elements, even if amended later during prosecution.

What is claimed is:

1. An electrophotographic device, comprising:

electrostatic latent image forming means for forming an electrostatic latent image on a photosensitive body;

developing means for forming a visible image from the electrostatic latent image on said photosensitive body;

transferring means for transferring the visible image onto a sheet;

a guide member;

transporting means for transporting the sheet along a transport path defined by said guide member to said transferring means; and a shape-correcting device for removing arcuate shaping from the sheet as the sheet is transported along the transport path, said shape-correcting device including:

an arcuate section formed on a section of guide member in the transport path, said arcuate section being convex relative to a surface of the sheet on which the visible image is to be formed;

a rotatable roller, positioned opposite said arcuate section, for pressing the sheet against said arcuate section of said guide member; and driving means for driving said rotatable roller in synchronism with a transport timing of the sheet to remove the arcuate shaping from the sheet as the sheet is transported through the shape-correcting device.

2. The electrophotographic device as claimed in claim 1, wherein said driving means drives said rotatable roller when a leading end of the sheet reaches said arcuate section of said guide member.

3. The electrophotographic device as claimed in claim 1, wherein said rotatable roller is slidable in a direction perpendicular to a roller rotation axis and is formed with a rotation radius substantially identical to a curvature radius of said arcuate-section.

4. The electrophotographic device as claimed in claim 3, wherein a plurality of ones of said rotatable roller are provided on a single axis.

5. The electrophotographic device as claimed in claim 1, wherein said rotatable roller includes an elastic member pushing said roller in a direction perpendicular to a roller rotation axis to press the sheet against said arcuate section of said guide member.

6. The electrophotographic device as claimed in claim 5, wherein a pressure applied by said elastic member when the sheet is pressed against said arcuate section of said guide member 2±0.4 (gf) per 1 mm sheet unit length.

7. An electrophotographic device, comprising:

a holding section for holding a sheet;

an image forming module including a photosensitive body, developing means, and transferring means;

transporting means for transporting the sheet from said holding section along a transport path to said image forming module;

fixing means for fusing onto the sheet a visible image transferred by said image forming module;

reversing means for reversing the sheet after passing said fixing means to allow two-sided printing;

return-transporting means for transporting the reversed sheet back to said image forming module along a return transport path; and a shape-correcting device for removing arcuate shaping from the sheet as the sheet is transported through said shape-correcting device, said shape-correcting device attached downstream from a merging point between the transport path and the return transport path and upstream from said image forming module.

8. The electrophotographic device as claimed in claim 7, wherein said shape-correcting device includes:

a guide member defining at least a portion of the transport path;

an arcuate section formed on a section of said guide member in said transport path, said arcuate section being convex relative to a surface of the sheet on which the visible image will be formed;

a rotatable roller, positioned opposite said arcuate section of said guide member, for pressing the sheet against said arcuate section of said guide member; and driving means for driving said rotatable roller in synchronism with a transport timing of the sheet to remove the arcuate shaping from the sheet.

9. The electrophotographic device as claimed in claim 8, wherein said shape-correcting device further includes:

timing means for driving said rotatable roller with a predetermined timing.

10. The electrophotographic device as claimed in claim 9, wherein said timing means drives said rotatable roller when a leading end of the sheet reaches said arcuate section of said guide member.

11. The electrophotographic device as claimed in claim 8, wherein said rotatable roller is slidable in a direction perpendicular to a roller rotation axis and is formed with a rotation radius substantially identical to a curvature radius of said arcuate section.

12. The electrophotographic device as claimed in claim 8, wherein a plurality of ones of said rotatable roller are provided on a single axis.

13. The electrophotographic device as claimed in claim 8, wherein said rotatable roller includes an elastic member pushing said roller in a direction perpendicular to a roller rotation axis to press the sheet against said arcuate section of said guide member.

14. The electrophotographic device as claimed in claim 13, wherein a pressure applied by said elastic member when the sheet is pressed against said arcuate section of said guide member is 2±0.4 (gf) per 1 mm sheet unit length.

15. A shape-correcting device for removing arcuate shaping from a sheet, said shape-correcting device comprising:

a guide member for guiding a sheet along a predetermined transport path;

an arcuate section formed on a section of said guide member;

a roller positioned opposite said arcuate section to press the sheet against said arcuate section as the sheet moves along the predetermined transport path between said roller and said arcuate section; and a driving mechanism for driving said roller.

16. The shape-correcting device of claim 15, wherein said arcuate section is convex relative to a surface of said sheet on which a visible image is to be formed.

17. The shape-correcting device of claim 15, further comprising:

a timer for driving said roller at a predetermined timing, wherein said predetermined timing is synchronized with a transport timing of said sheet.

18. The shape-correcting device of claim 17, wherein said timer causes said driving mechanism to drive said roller when a leading end of the sheet reaches said arcuate section of said guide member.

19. The shape-correcting device of claim 15, wherein said roller has a rotation axis, is slidable in a direction perpendicular to the rotation axis, and is formed with a rotation radius substantially identical to a curvature radius of said arcuate section.

20. The shape correcting device as claimed in claim 19, wherein said roller includes an elastic member pushing said roller in a direction perpendicular to the roller rotation axis to press the sheet against said arcuate section of said guide member.

21. The shape correcting device as claimed in claim 19, further comprising a timer for causing said driving mechanism to drive said roller with a predetermined timing synchronized with a transport timing of the sheet.

22. The shape correcting device as claimed in claim 21, wherein said timer causes said driving mechanism to drive said roller when a leading end of the sheet reaches said arcuate section of said guide member.

23. The shape-correcting device of claim 15, wherein said roller has a rotation axis and includes an elastic member applying pressure to said roller in a direction perpendicular to the rotation axis to press the sheet against said arcuate section of said guide member.

24. The shape correcting device as claimed in claim 23, further comprising a timer for causing said driving mechanism to drive said roller with a predetermined timing synchronized with a transport timing of the sheet.

25. The shape correcting device as claimed in 24, wherein said timer causes said driving mechanism to drive said roller when a leading end of the sheet reaches said arcuate section of said guide member.

26. An electrophotographic device, comprising:

a holding section for holding a sheet;

an image forming module including a photosensitive body, a developer, and a transferring mechanism;

a transporting mechanism for transporting the sheet from said holding section along a transport path to said image forming module;

an image fixer for fusing onto the sheet a visible image transferred by said image forming module;

a reversing mechanism for reversing the sheet the sheet passes said image fixer to allow two-sided printing;

a return-transporting mechanism for transporting the reversed sheet back to said image forming module along a return transport path; and a shape-correcting device for removing arcuate shaping from the sheet, said shape-correcting device attached downstream from a merging point between the transport path and the return transport path and upstream from said image forming module.

27. The electrophotographic device as claimed in claim 26, wherein said shape-correcting device for sheets includes:

a guide member defining at least a portion of the transport path;

an arcuate section formed on a section of said guide member, said arcuate section being convex relative to a surface of the sheet on which the visible image will be formed;

a rotatable roller, positioned opposite said arcuate section of said guide member, for pressing the sheet against said arcuate section of said guide member; and driving means for driving said rotatable roller in synchronism with a transport timing of the sheet to remove arcuate shaping from the sheet.

28. The electrophotographic device as claimed in claim 27, wherein said rotatable roller is slidable in a direction perpendicular to a roller rotation axis and is formed with a rotation radius substantially identical to a curvature radius of said arcuate section.

29. The electrophotographic device as claimed in claim 27, wherein said rotatable roller includes an elastic member pushing said roller in a direction perpendicular to a roller rotation axis to press the sheet against said arcuate section of said guide member.

30. A method of shape-correcting sheets, comprising:

transporting a sheet along a predetermined transport path, said predetermined transport path including a path between an arcuate section formed on a section of a sheet guide member and a roller positioned opposite said arcuate section;

driving said roller in synchronization with a transport timing of the sheet; and pushing said roller in a direction perpendicular to a roller rotation axis to press the sheet against said arcuate section of the sheet guide member.

31. The method of claim 30, wherein said pushing of said roller is performed with a predetermined timing in synchronization with when a leading end of the sheet reaches said arcuate section of said guide member.

32. The method of claim 30, wherein a pressure applied by said pushing of said roller and pressing the sheet is 2±0.4 (gf) per 1 mm sheet unit length.

33. A shape-correcting device for a sheet, comprising:

a guide member for guiding a sheet along a predetermined transport path, said guide member including an arcuate section;

a roller positioned opposite said arcuate section;

a driving mechanism for driving said roller; and a timer for causing said driving mechanism to drive said roller with a predetermined timing synchronized with a transport timing of the sheet.

34. The shape-correcting device of claim 33, wherein said arcuate section is convex relative to a surface of the sheet on which a visible image is to be formed.

35. The shape-correcting device of claim 33, wherein said roller is positioned such that a sheet being transported along the predetermined transport path between said roller and said arcuate section is pressed against said arcuate section.

36. The shape-correcting device of claim 33, wherein said timer causes said driving mechanism to drive said roller when a leading end of the sheet reaches said arcuate section of said guide member.

37. The shape-correcting device of claim 33, wherein said roller is slidable in a direction perpendicular to a roller rotation axis and is formed with a rotation radius substantially identical to a curvature radius of said arcuate section.

38. The shape-correcting device of claim 33, wherein said roller includes an elastic member for applying pressure to said roller in a direction perpendicular to a roller rotation axis to press the sheet against said arcuate section of said guide member.

39. A shape-correcting device for a sheet, comprising:

a guide member for guiding a sheet along a predetermined transport path, said guide member including an arcuate section formed;

a roller positioned opposite said arcuate section;

a driving mechanism for driving said roller, wherein said roller is slidable in a direction perpendicular to a roller rotation axis and is formed with a rotation radius substantially identical to a curvature radius of said arcuate section.

40. A shape-correcting device for a sheet, comprising:

a guide member for guiding a sheet along a predetermined transport path, said guide member including an arcuate section formed;

a roller positioned opposite said arcuate section;

a driving mechanism for driving said roller, wherein said roller includes an elastic member for applying pressure to said roller in a direction perpendicular to a roller rotation axis to press the sheet against said arcuate section of said guide member.

41. A shape-correcting device for a sheet, said shape-correcting device comprising:

a guide member for guiding a sheet along a predetermined transport path;

an arcuate section formed on a section of said guide member;

a roller positioned opposite said arcuate section; and a driving mechanism for driving said roller, wherein:

said roller has a rotation axis and is slidable in a direction perpendicular to the rotation, and said roller includes an elastic member for pushing said roller in said direction to press the sheet against said arcuate section of said guide member.

* * * * *